US007018179B2

(12) United States Patent
Hirota

(10) Patent No.: US 7,018,179 B2
(45) Date of Patent: Mar. 28, 2006

(54) CAPACITY CONTROL VALVE FOR VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 386 days.

(21) Appl. No.: 10/429,025

(22) Filed: May 5, 2003

(65) Prior Publication Data

US 2003/0210988 A1 Nov. 13, 2003

(30) Foreign Application Priority Data

May 13, 2002 (JP) ..... 2002-136454

(51) Int. Cl.
*F04B 1/29* (2006.01)

(52) U.S. Cl. ..... 417/222.2

(58) Field of Classification Search ..... 417/222.2
See application file for complete search history.

(56) References Cited

U.S. PATENT DOCUMENTS

| | | | | |
|---|---|---|---|---|
| 6,010,312 | A * | 1/2000 | Suitou et al. | 417/222.2 |
| 6,354,811 | B1 * | 3/2002 | Ota et al. | 417/222.2 |
| 6,361,283 | B1 * | 3/2002 | Ota et al. | 417/222.2 |
| 6,481,976 | B1 * | 11/2002 | Kimura et al. | 417/222.2 |
| 6,524,077 | B1 * | 2/2003 | Suitou et al. | 417/222.2 |
| 6,662,581 | B1 * | 12/2003 | Hirota et al. | 417/222.2 |

FOREIGN PATENT DOCUMENTS

JP 61-286591 * 12/1986

JP 3-23385 * 1/1991

OTHER PUBLICATIONS

Patent Abstracts of Japan, No. 2001-132650, dated May 18, 2001.

* cited by examiner

*Primary Examiner*—Michael Koczo, Jr.
(74) *Attorney, Agent, or Firm*—Westerman, Hattori, Daniels & Adrian, LLP

(57) ABSTRACT

The object of the present invention is to provide a capacity control valve for a variable displacement compressor, which is not adversely affected by pressure from a pressure-regulating chamber. A three-way valve structure is formed in which a high-pressure valve element and a low-pressure valve element are integrally formed at both ends, and valve seats with valve holes having the same diameter are arranged in a manner opposed to the respective valve elements. A discharges pressure is supplied from the upstream side of the valve seat, and a suction pressure is supplied from the downstream side of the valve seat. Pressures from a pressure-regulating chamber are received at the downstream side of the high-pressure valve element and the upstream side of the low-pressure valve element. Further, a solenoid is included for applying a load corresponding to a differential pressure at which the variable displacement compressor starts capacity control, to the high-pressure valve element and the low-pressure valve element, by a shaft via a valve hole of the valve seat. The valve holes are formed to have the same diameter, whereby it is possible to cancel out the pressures from the pressure-regulating chamber and perform capacity control only in response to the differential pressure between the discharge pressure a and the suction pressure.

5 Claims, 8 Drawing Sheets

CAPACITY CONTROL VALVE FOR VARIABLE DISPLACEMENT COMPRESSOR

CROSS-REFERENCE TO RELATED APPLICATIONS, IF ANY

This application claims priority of Japanese Application No. 2002-136454 filed on May 13, 2002 and entitled "Capacity Control Valve for Variable Displacement Compressor".

BACKGROUND OF THE INVENTION (1) Field of the Invention

This invention relates to a capacity control valve for a variable displacement compressor, and more particularly to a capacity control valve for use in a variable displacement compressor for compressing a refrigerant gas in a refrigeration cycle of an automotive air conditioner.

(2) Description of the Related Art

A compressor used for compressing refrigerant in a refrigeration cycle of an automotive air conditioner is driven by an engine, and hence is not capable of controlling the rotational speed thereof. For this reason, a variable displacement compressor capable of changing the compression capacity for compressing refrigerant is employed so as to obtain adequate refrigerating capacity without being constrained by the rotational speed of the engine.

In such a variable displacement compressor, compression pistons are connected to a wobble plate fitted on a shaft driven for rotation by the engine, and the angle of the wobble plate is changed to change the stroke of the pistons for changing the discharge amount of the compressor.

The angle of the wobble plate is continuously changed by introducing part of the compressed refrigerant into a gastight pressure-regulating chamber and changing the pressure of the introduced refrigerant, thereby changing a balance between pressures applied to the both ends of each piston.

To control the amount of refrigerant introduced into the pressure-regulating chamber of the variable displacement compressor, in a compression capacity control device described e.g. in Japanese Laid-Open Patent Publication (Kokai) No. 2001-132650, there have been proposed a construction in which a capacity control valve is disposed between a discharge chamber and a pressure-regulating chamber of the variable displacement compressor, and an orifice is provided between the pressure-regulating chamber and a suction chamber, and a construction in which an orifice is provided between a discharge chamber and a pressure-regulating chamber, and a capacity control valve is disposed between the pressure-regulating chamber and a suction chamber.

Each of the capacity control valves opens and closes the communication between the chambers such that a differential pressure across the capacity control valve is maintained at a predetermined value, and the capacity control valve is implemented by a solenoid control valve capable of externally setting the predetermined value of the differential pressure by a current value. Thus, when the engine rotational speed increases, the capacity control valve is opened between the discharge chamber and the pressure-regulating chamber, or the capacity control valve is closed between the pressure-regulating chamber and the suction chamber, whereby the pressure introduced into the pressure-regulating chamber is increased to reduce the volume of refrigerant that can be compressed, while when the engine rotational speed decreases, the capacity control valve is reversely controlled such that the pressure introduced into the pressure-regulating chamber is decreased to increase the volume of refrigerant that can be compressed, whereby the pressure of refrigerant discharged from the variable displacement compressor is maintained at a constant level irrespective of the engine rotational speed.

However, in the conventional capacity control valve for the variable displacement compressor, not only the capacity control valve but also an orifice is arranged in the passage leading from the discharge chamber to the suction chamber via the pressure-regulating chamber of the variable displacement compressor, and the orifice is determined by taking into account the amount of leakage of refrigerant from the discharge chamber to the suction chamber. Actually, however, it is difficult to set an appropriate size of the orifice due to varied manufacturing tolerances of the variable displacement compressor. Further, the variable displacement compressor is controlled such that the differential pressure between a discharge pressure and a suction pressure is held constant. However, since the capacity control valve in charge of the control is inserted between the pressure-regulating chamber and the discharge chamber or the suction chamber, the capacity control valve is sometimes adversely affected by the pressure from the pressure-regulating chamber during capacity control operation.

SUMMARY OF THE INVENTION

The present invention has been made in view of the above circumstances, and an object thereof is to provide a capacity control valve for a variable displacement compressor, for allowing a variation in size of orifices without being adversely affected by pressure from a pressure-regulating chamber.

To solve the above problem, the present invention provides a capacity control valve for a variable displacement compressor, for controlling an amount of refrigerant introduced from a discharge chamber into a pressure-regulating chamber, such that the differential pressure between a pressure in a suction chamber and a pressure in the discharge chamber is held at a predetermined differential pressure, to thereby change an amount of the refrigerant discharged from the variable displacement compressor, characterized by comprising a first valve inserted into a first refrigerant passage between a first port communicating with the discharge chamber and a second port communicating with the pressure-regulating chamber, for opening and closing the first refrigerant passage, and a second valve inserted into a second refrigerant passage between the second port communicating with the pressure-regulating chamber and a third port communicating with the suction chamber, the second valve having the same effective diameter as that of the first valve, for opening and closing the second refrigerant passage in conjunction with the first valve.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
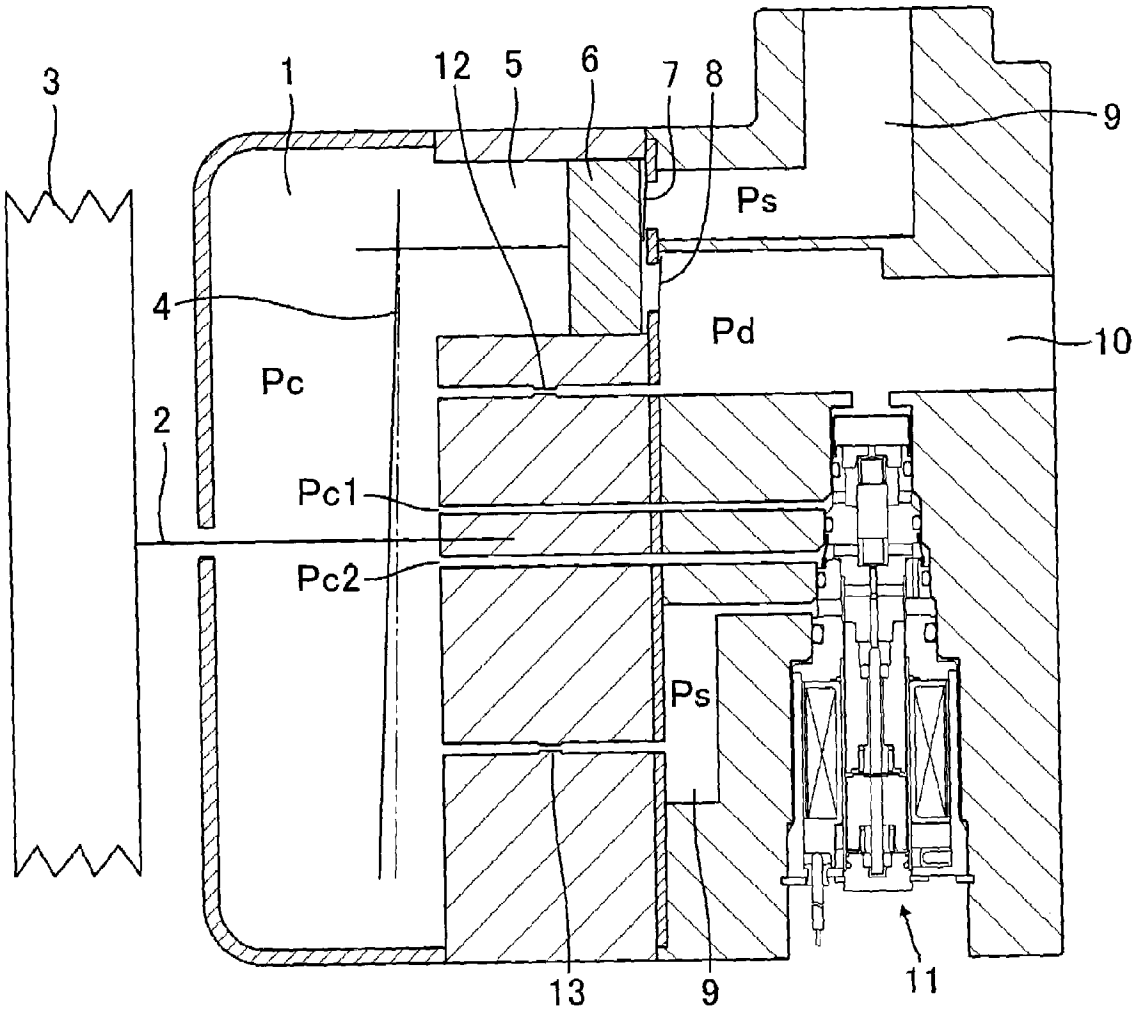
FIG. 1 is a cross-sectional view schematically showing the arrangement of a variable displacement compressor to which is applied a capacity control valve according to the invention.

FIG. 1 is a cross-sectional view schematically showing a variable displacement compressor to which is applied a capacity control valve according to the invention.

The variable displacement compressor includes a pressure-regulating chamber 1 formed gastight and a rotating shaft 2 rotatably supported in the pressure-regulating chamber 1. The rotating shaft 2 has one end extending outward from the pressure-regulating chamber 1 via a shaft sealing device, not shown, and having a pulley 3 fixed thereto which receives a driving force transmitted from an output shaft of an engine via a clutch and a belt. A wobble plate 4 is fitted on the rotating shaft 2 such that the inclination angle of the wobble plate 4 can be changed with respect to the axis of the rotating shaft 2. A plurality of cylinders 5 (only one of which is shown in the figure) are arranged around the axis of the rotating shaft 2. In each cylinder 5, there is arranged a piston 6 for converting rotating motion of the wobble plate 4 to reciprocating motion. Each of the cylinders 5 is connected to a suction chamber 9 and a discharge chamber 10 via a suction relief valve 7 and a discharge relief valve 8, respectively. The respective suction chambers 9 associated with the cylinders 5 communicate with each other to form one chamber which is connected to an evaporator of a refrigeration cycle. Similarly, the respective discharge chambers 10 associated with the cylinders 5 communicate with each other to form one chamber which is connected to a gas cooler or a condenser of the refrigeration cycle.

In the variable displacement compressor, a capacity control valve 11 including a three-way valve is arranged across respective intermediate portions of a refrigerant passage communicating between the discharge chamber 10 and the pressure-regulating chamber 1 and a refrigerant passage communicating between the pressure-regulating chamber 1 and the suction chamber 9. Between the discharge chamber 10 and the pressure-regulating chamber 1 and between the pressure-regulating chamber 1 and the suction chamber 9, there are arranged orifices 12, 13, respectively. Although the orifices 12, 13 are formed in a body of the variable displacement compressor, they may be formed in the capacity control valve 11.

In the variable displacement compressor constructed as above, as the rotating shaft 2 is rotated by the driving force of the engine, the wobble plate 4 fitted on the rotating shaft 2 rotates, and each piston 6 connected to the wobble plate 4 performs reciprocating motion. This causes refrigerant within the suction chamber 9 to be drawn into a cylinder 5, and compressed therein, and then the compressed refrigerant to be delivered to the discharge chamber 10.

Now, during normal operation, responsive to a discharge pressure Pd of refrigerant discharged from the discharge chamber 10, the capacity control valve 11 controls the amount of refrigerant introduced into the pressure-regulating chamber 1 (a pressure in the pressure-regulating chamber 1 at this time is indicated by Pc1 in the figure), and the amount of refrigerant introduced from the pressure-regulating chamber 1 into the suction chamber 9 (a pressure in the pressure-regulating chamber 1 at this time is indicated by Pc2 in the figure) in an interlocked manner such that the differential pressure between the discharge pressure Pd and a suction pressure Ps in the suction chamber 9 is held at a predetermined differential pressure. As a result, pressure Pc (=Pc1=Pc2) in the pressure-regulating chamber 1 is held at a predetermined value, whereby the capacity of each cylinder 5 is controlled to a predetermined value.

Further, during the minimum operation, the capacity control valve 11 fully opens the refrigerant passage for introducing refrigerant from the discharge chamber 10 to the pressure-regulating chamber 1 and fully closes the refrigerant passage for introducing refrigerant from the pressure-regulating chamber 1 to the suction chamber 9. At this time, although the capacity control valve 11 blocks the refrigerant passage from the pressure-regulating chamber 1 to the suction chamber 9, a very small amount of refrigerant is permitted to flow via the orifice 13.

During the maximum operation, the capacity control valve 11 fully closes the refrigerant passage for introducing refrigerant from the discharge chamber 10 to the pressure-regulating chamber 1 and fully opens the refrigerant passage for introducing refrigerant from the pressure-regulating chamber 1 to the suction chamber 9. At this time, although the capacity control valve 11 blocks the refrigerant passage from the discharge chamber 10 to the pressure-regulating chamber 1, a very small amount of refrigerant is permitted to be introduced into the pressure-regulating chamber 1 via the orifice 12 whereby lubricating oil contained in the refrigerant is supplied to the pressure-regulating chamber 1.

Next, the capacity control valve 11 according to the invention will be described in detail.

Figure 2:
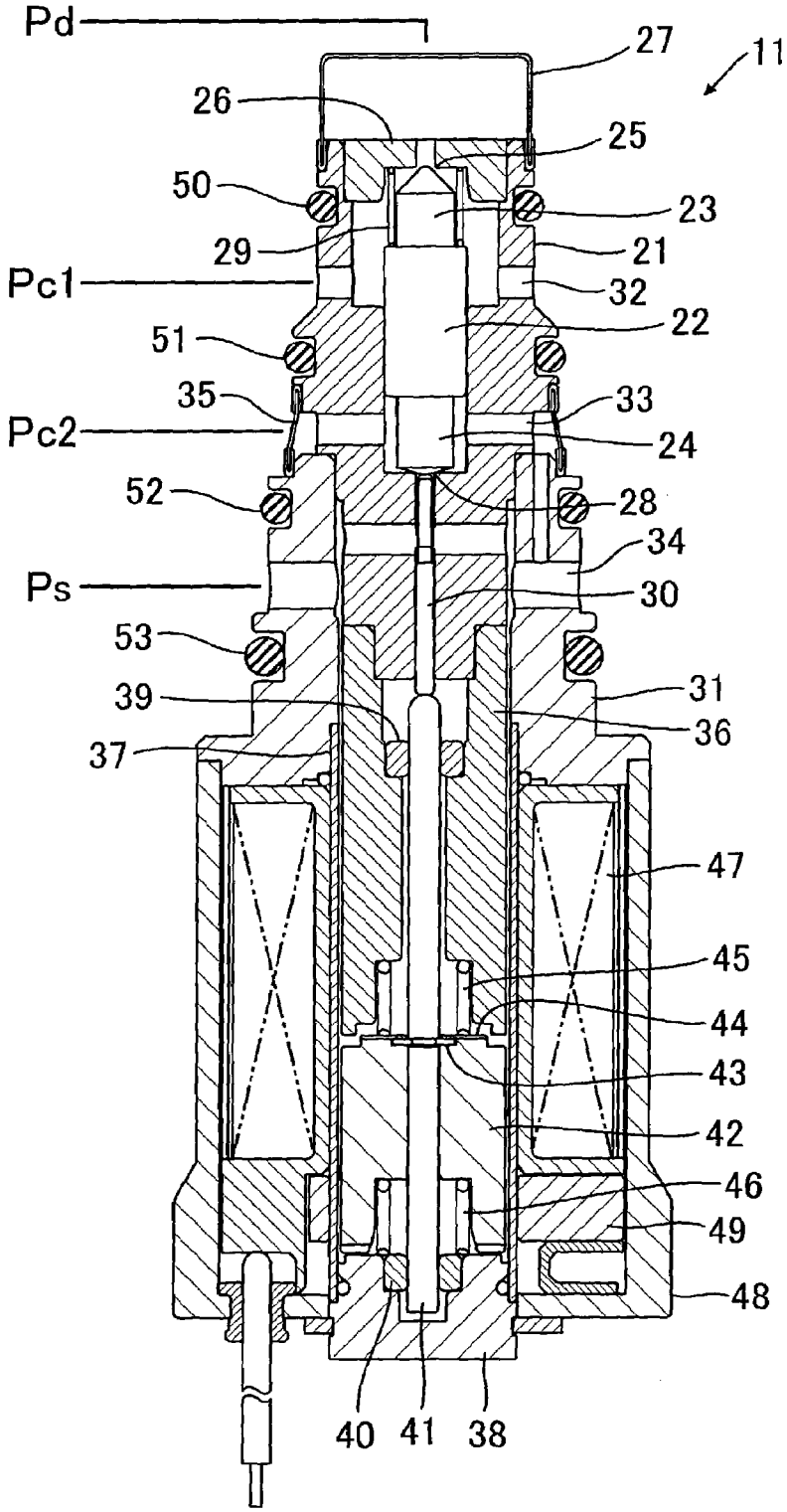
FIG. 2 is a central longitudinal sectional view showing a capacity control valve according to a first embodiment.

FIG. 2 is a central longitudinal sectional view showing a capacity control valve according to a first embodiment.

This capacity control valve 11 forms a three-way solenoid valve. More specifically, the capacity control valve 11 has a valve element 22 of a three-way valve, which is axially movably held in a central hole of a body 21. The valve element 22 has a high-pressure valve element 23 and a low-pressure valve element 24 integrally formed therewith at respective both ends thereof along the axis of the body 21. The high-pressure valve element 23 has an end formed to have an acute angle, while the low-pressure valve element 24 has an end formed to have an obtuse angle.

A plug 26 forming a valve seat 25 for the high-pressure valve element 23 is fitted in an opening end of the central hole of the body 21 and a filter 27 is attached on the circumferential end of the body 21. The body 21 also has a valve seat 28 for the low-pressure valve element 24 integrally formed therewith along the axis thereof. Arranged between the plug 26 and the valve element 22 is a spring 29 for urging the valve element 22 in a direction in which the high-pressure valve element 23 is moved away from the valve seat 25 and at the same time in a direction in which the low-pressure valve element 24 is seated on the valve seat 28.

In the three-way valve constructed as above, the high-pressure side valve seat 25 and the low-pressure side valve seat 28 have respective valve holes formed to have effective diameters of the same size.

The valve hole of the valve seat 28 along the axis of the body 21 is formed to extend with an inner diameter of the same size through the body 21 to a lower end portion thereof, as viewed in the figure. The through hole has a shaft 30 axially movably held therein. The shaft 30 has a reduced diameter at a portion toward the valve element 22 such that a refrigerant passage is formed between the portion and an inner wall of the through hole, and an upper end portion thereof is in abutment with the low-pressure valve element 24. The body 21 has a lower end portion fitted in a central hole of another body 31.

It should be noted that a portion of the body 21 supporting the valve element 22 provides a partition between a space on high-pressure inlet side and a space on a low-pressure outlet side, and that ports 32, 33 are formed in the body 21 on a downstream side of the high-pressure valve element 23 and on an upstream side of the low-pressure valve element 24, respectively, in a manner corresponding to the two refrigerant passages communicating with the pressure-regulating chamber 1 of the variable displacement compressor. Further, a port 34 is formed in the body 31 on a downstream side of the low-pressure valve element 24 in a manner corresponding to a refrigerant passage communicating with the suction chamber 9 of the variable displacement compressor. A filter 35 is circumferentially arranged for an entrance to the port 33.

The body 31 has a solenoid arranged at a lower end thereof. The solenoid has a fixed core 36 whose upper end is fitted on a lower end of the body 21. To the lower end of the body 31 is rigidly secured an upper end of a sleeve 37. The sleeve 37 has a lower end thereof closed by a stopper 38. A guide 39 is fixed by press-fitting in a central space formed in an upper portion of the fixed core 36, and a guide 40 is fixed by press-fitting in a central space formed in an upper portion of the stopper 38. The guides 39, 40 axially slidably support the shaft 41 by two-point support. The upper end of the shaft 41 is in abutment with a lower end of the shaft 30. A movable core 42 is arranged between the fixed core 36 and the stopper 38, and supported by the shaft 41. The movable core 42 has an upper end in abutment with an E ring 43 fitted on the shaft 41. Between the E ring 43 and the fixed core 36 are arranged a washer 44 and a spring 45, and between the stopper 38 and the movable core 42 is arranged a spring 46. A solenoid coil 47, a yoke 48, and a plate 49 are arranged around an outer periphery of the sleeve 37.

Further, the body 21 has O rings 50, 51 arranged around the periphery thereof at respective upper and lower locations of the port 32, and the body 31 has O rings 52, 53 arranged around the periphery thereof at respective upper and lower locations of the port 34.

Here, description will be given of the relationship between pressures in the capacity control valve 11. First, the effective diameter of the valve seat 25 facing the high-pressure valve element 23 and that of the valve seat 28 facing the low-pressure valve element 24 are made equal in size, so that respective effective pressure-receiving areas of the high-pressure valve element 23 and the low-pressure valve element 24 are equal to each other. The pressures Pc1, Pc2 substantially equal to the pressure Pc in the pressure-regulating chamber 1 are applied to the respective pressure-receiving areas, equal to each other, of the high-pressure valve element 23 and the low-pressure valve element 24 in axially opposite directions, which cancels out influence of the pressure Pc on the valve element 22. This causes the three-way valve to be basically operated only by the differential pressure between the discharge pressure Pd supplied from the discharge chamber 10 and the suction pressure Ps supplied from the suction chamber 9 via the port 34.

Further, the suction pressure Ps in the port 34 is introduced into a space between the fixed core 36 and the movable core 42 through between the body 31 and the fixed core 36, and between the sleeve 37 and the fixed core 36, and further into a space between the body 21 and the fixed core 36 through a gap between the shaft 41 and the fixed core 36, and a clearance between the shaft 41 and the guide 39. Further, the suction pressure Ps in the port 34 is introduced into a space between the movable core 42 and the stopper 38 via a gap between the sleeve 37 and the movable core 42, and further into a space between the shaft 41 and the stopper 38 via a clearance between the shaft 41 and the guide 40, so that the inside of the solenoid is filled with the low suction pressure Ps.

In the capacity control valve 11 having the three-way valve configured as above, when no control current is supplied to the solenoid coil 47 of the solenoid, as shown in FIG. 2, the movable core 42 is urged by the spring 45 in a direction in which the movable core 42 is moved away from the fixed core 36, and the valve element 22 is urged toward the solenoid by the spring 29. Hence, the high-pressure valve element 23 is fully opened, whereas the low-pressure valve element 24 is fully closed. In this state, when the discharge pressure Pd is introduced, it is introduced into the pressure-regulating chamber 1 via the three-way valve. Since the refrigerant passage leading from the pressure-regulating chamber 1 to the suction chamber 9 is closed by the three-way valve, the pressure of the pressure-regulating chamber 1 becomes closer to the discharge pressure Pd, which minimizes the difference between the pressures applied to the both end faces of the piston 6. As a result, the wobble plate 4 is controlled to a degree of inclination which minimizes the stroke of the pistons 6, whereby the operation of the variable displacement compressor is promptly switched to the minimum capacity operation.

When a maximum control current is supplied to the solenoid coil 47 of the solenoid, the movable core 42 is attracted by the fixed core 36 to be moved upward, as viewed in the figure, whereby the three-way valve has the high-pressure valve element 23 thereof fully close the passage associated therewith, and the low-pressure valve element 24 thereof fully open the passage associated therewith. Then, in addition to introduction of refrigerant from the pressure-regulating chamber 1 into the suction chamber 9 which has been effected via the orifice 13, refrigerant is permitted to flow into the suction chamber 9 from the port 33 communicating with the pressure-regulating chamber 1 via the three-way valve and the port 34. Therefore, the pressure Pc2 of the pressure-regulating chamber 1 becomes closer to the suction pressure Ps, which maximizes the difference between the pressures applied to the both end faces of the piston 6. As a result, the wobble plate 4 is controlled to a degree of inclination which maximizes the stroke of the pistons 6, whereby the variable displacement compressor is promptly switched to the maximum capacity operation.

During normal control in which a predetermined control current is supplied to the solenoid coil 47 of the solenoid, the movable core 42 is attracted by the fixed core 36 to be moved upward, as viewed in the figure, according to the magnitude of the control current. Thus, when the high-pressure valve element 23 is closed, only when the differential pressure between the discharge pressure Pd and the suction pressure Ps becomes larger than a value set according to the magnitude of the control current, the high-pressure valve element 23 is opened to start capacity control.

Figure 3:
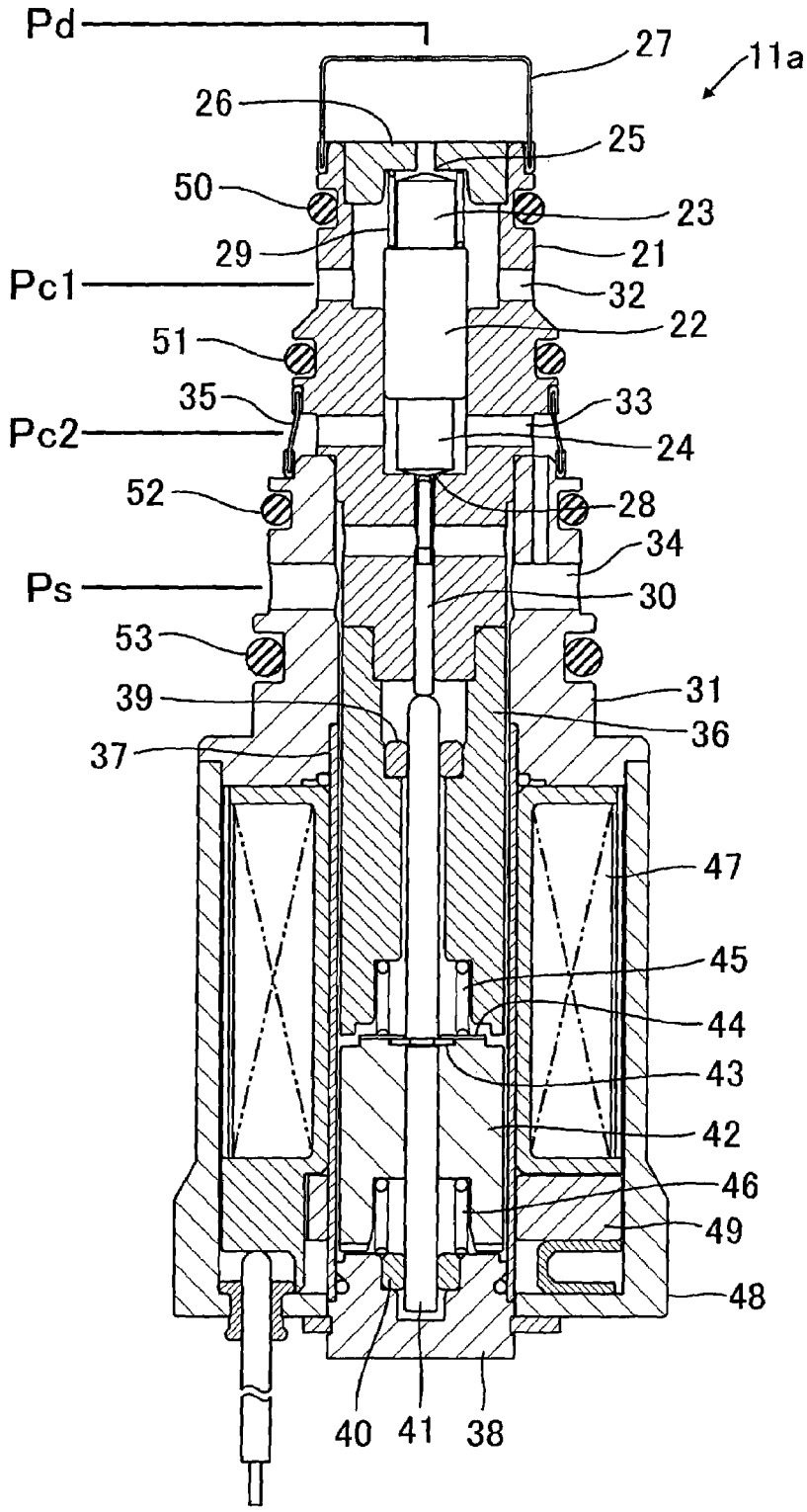
FIG. 3 is a central longitudinal sectional view showing a capacity control valve according to a second embodiment.
Figure 4:
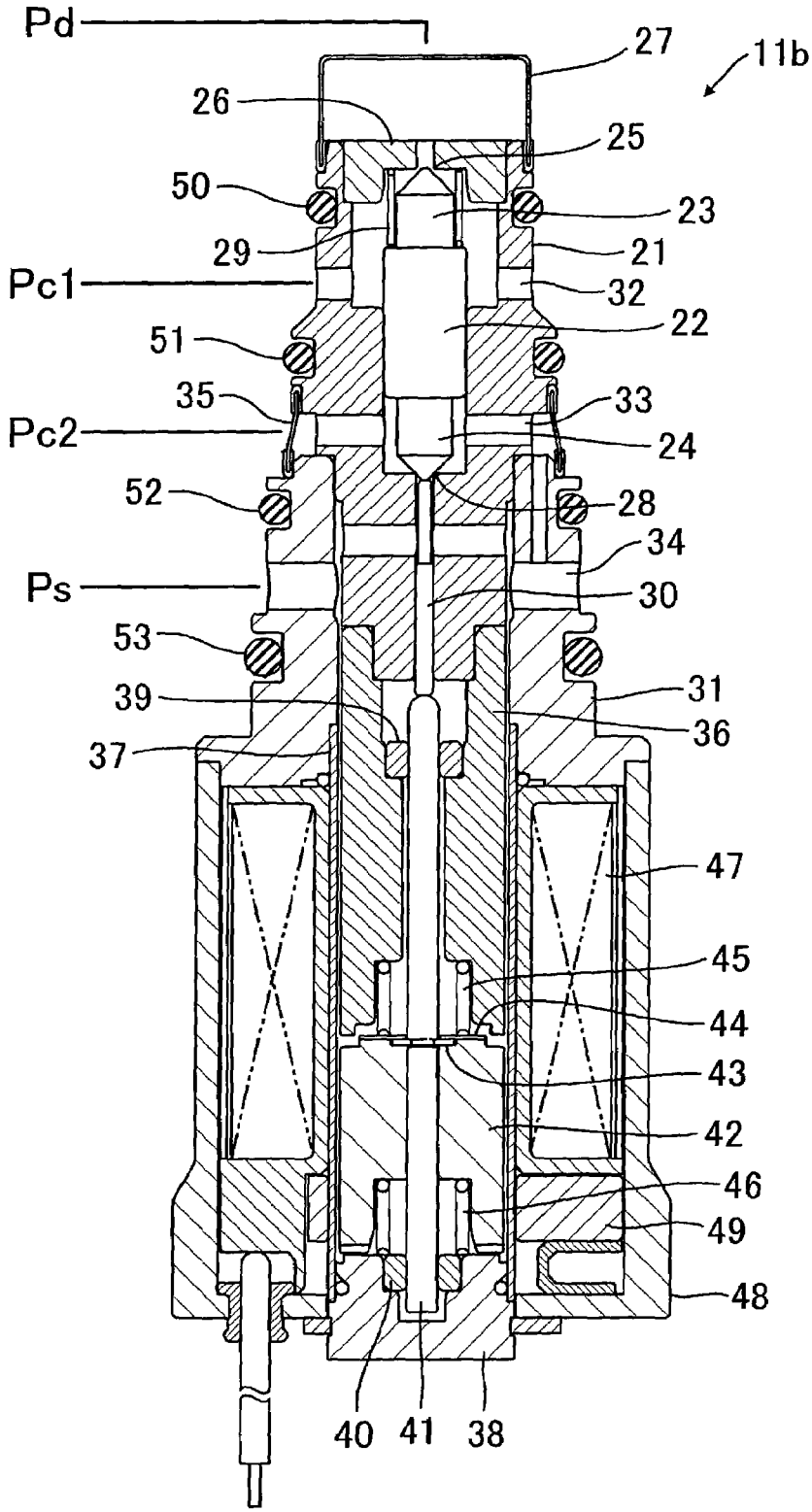
FIG. 4 is a central longitudinal sectional view showing a capacity control valve according to a third embodiment.

FIG. 3 is a central longitudinal sectional view showing a capacity control valve according to a second embodiment. FIG. 4 is a central longitudinal sectional view showing a capacity control valve according to a third embodiment. In FIGS. 3 and 4, component parts and elements similar to those shown in FIG. 2 are designated by identical reference numerals, and detailed description thereof is omitted.

The capacity control valves 11*a*, 11*b* according to the second and third embodiments basically have the same construction as the capacity control valve 11 according to the first embodiment. More specifically, the capacity control valves 11*a*, 11*b* are each configured such that a high-pressure side valve seat 25 and a low-pressure side valve seat 28 of a three-way valve have respective valve holes formed to have effective diameters of the same size, and a valve element 22 is urged by a solenoid via a shaft 30. However, the FIG. 3 capacity control valve 11*a* according to the second embodiment is different from the capacity control valve 11 according to the first embodiment in that respective ends of a high-pressure valve element 23 and a low-pressure valve element 24 are both formed to have an obtuse angle. The ends of the high-pressure valve element 23 and the low-pressure valve element 24 are thus configured to have the same shape, whereby it is possible to cause the high-pressure valve and the low-pressure valve to have the same flow rate characteristics when they open and close the refrigerant passages. Further, the FIG. 4 capacity control valve 11*b* according to the third embodiment is different from the capacity control valve 11 according to the first embodiment in that respective ends of a high-pressure valve element 23 and a low-pressure valve element 24 are both formed to have an acute angle.

Figure 5:
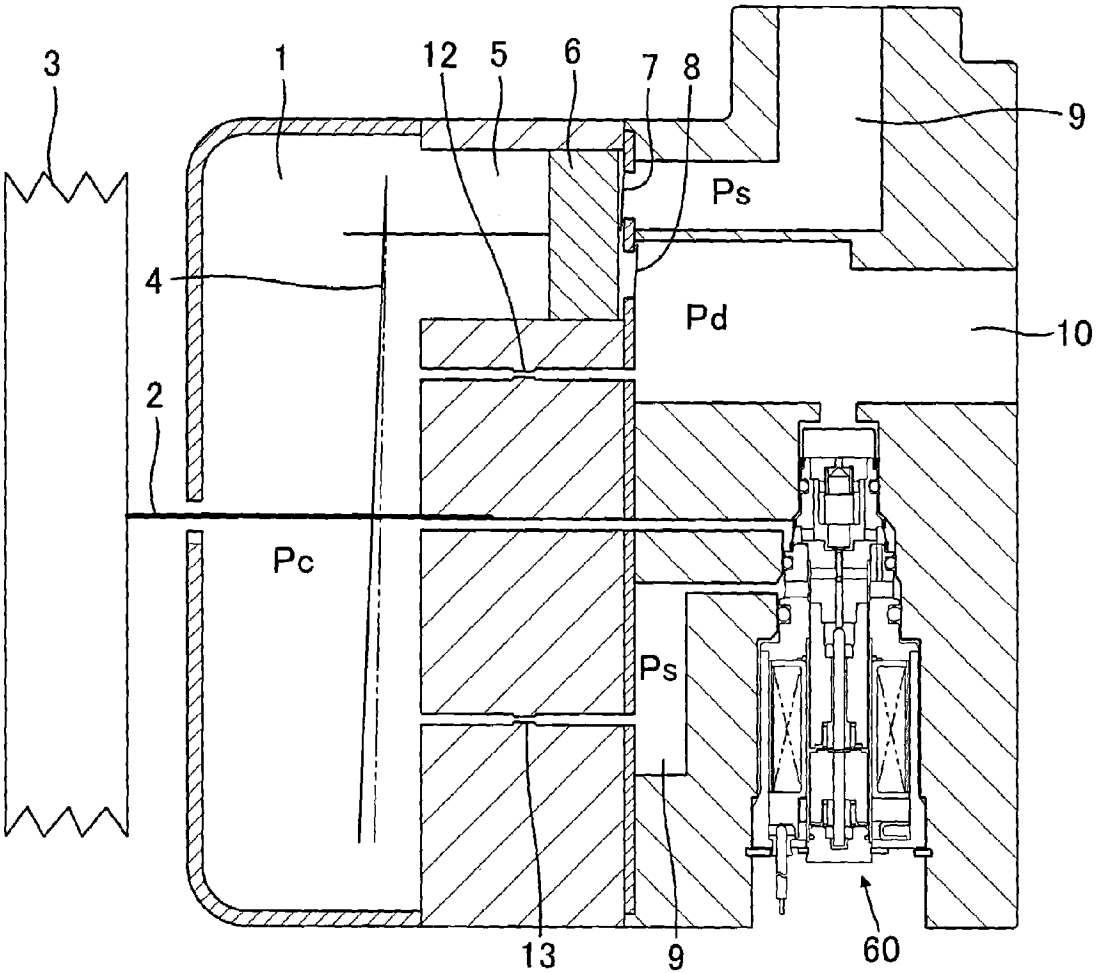
FIG. 5 is a cross-sectional view schematically showing the arrangement of a variable displacement compressor to which is applied another capacity control valve according to the invention.

FIG. 5 is a cross-sectional view schematically showing the arrangement of a variable displacement compressor to which is applied another capacity control valve according to the invention. In FIG. 5, component parts and elements similar to those shown in FIG. 1 are designated by identical reference numerals, and detailed description thereof is omitted.

In this variable displacement compressor, a capacity control valve 60 including a three-way valve is arranged across respective intermediate portions of a refrigerant passage communicating between a discharge chamber 10 and a pressure-regulating chamber 1 and a refrigerant passage communicating between the pressure-regulating chamber 1 and a suction chamber 9. Further, one common refrigerant passage is provided between the capacity control valve 60 and the pressure-regulating chamber 1.

In the variable displacement compressor constructed as above, as a rotating shaft 2 is rotated by the driving force of the engine, a wobble plate 4 fitted on the rotating shaft 2 rotates, and each piston 6 connected to the wobble plate 4 performs reciprocating motion. This causes refrigerant within the suction chamber 9 to be drawn into a cylinder 5, and compressed therein, and the compressed refrigerant to be delivered to the discharge chamber 10.

At this time, during normal operation, responsive to a discharge pressure Pd of refrigerant discharged from the discharge chamber 10, the capacity control valve 60 controls the amount of refrigerant introduced into the pressure-regulating chamber 1, and the amount of refrigerant bypassed to the suction chamber 9, which is part of the refrigerant to be introduced into the pressure-regulating chamber 1, such that the differential pressure between the discharge pressure Pd and a suction pressure Ps from the suction chamber 9 is held at a predetermined pressure. As a result, a pressure Pc in the pressure-regulating chamber 1 is held at a predetermined value, whereby the capacity of each cylinder 5 is controlled to a predetermined value. After that, the pressure Pc in the pressure-regulating chamber 1 is returned to the suction chamber 9 via an orifice 13.

During the minimum operation, the capacity control valve 60 fully opens the refrigerant passage for introducing refrigerant from the discharge chamber 10 to the pressure-regulating chamber 1 and fully closes the refrigerant passage for introducing refrigerant from the pressure-regulating chamber 1 to the suction chamber 9. At this time, although the capacity control valve 60 blocks the refrigerant passage from the pressure-regulating chamber 1 to the suction chamber 9, a very small amount of refrigerant is permitted to flow via the orifice 13.

During the maximum operation, the capacity control valve 60 fully closes the refrigerant passage for introducing refrigerant from the discharge chamber 10 to the pressure-regulating chamber 1 and fully opens the refrigerant passage for introducing refrigerant from the pressure-regulating chamber 1 to the suction chamber 9. At this time, although the capacity control valve 60 blocks the refrigerant passage from the discharge chamber 10 to the pressure-regulating chamber 1, a very small amount of refrigerant is permitted to be introduced into the pressure-regulating chamber 1 via an orifice 12 such that lubricating oil contained in the refrigerant is supplied to the pressure-regulating chamber 1.

Next, the capacity control valve 60 for carrying out the above control operations will be described in detail.

Figure 6:
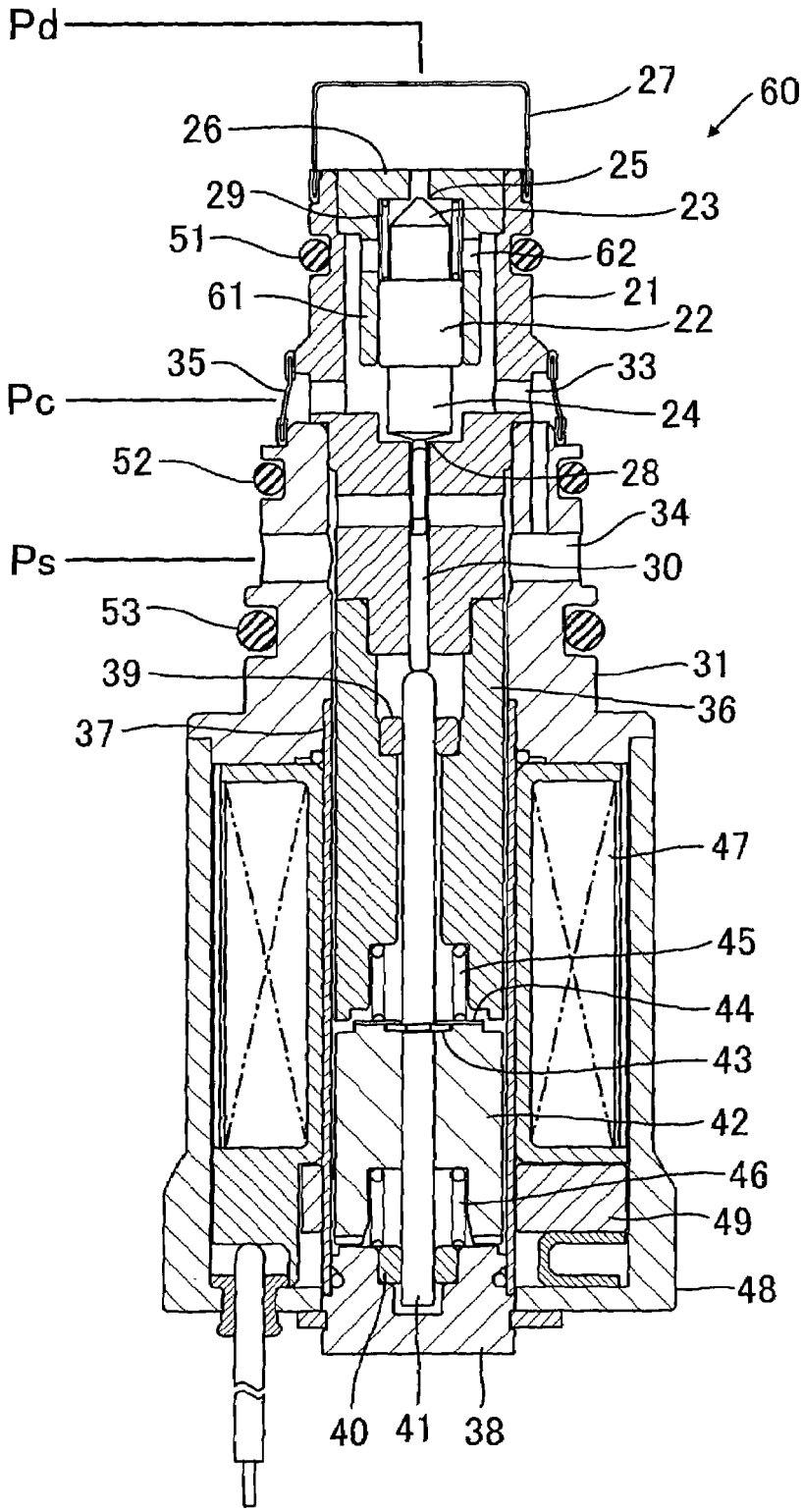
FIG. 6 is a central longitudinal sectional view showing a capacity control valve according to a fourth embodiment.

FIG. 6 is a central longitudinal sectional view showing a capacity control valve according to a fourth embodiment.

Similarly to the capacity control valves according to the above embodiments, this capacity control valve 60 as well is configured such that a high-pressure side valve seat 25 and a low-pressure side valve seat 28 of a three-way valve have respective valve holes formed to have effective diameters of the same size. In the capacity control valve 60, a valve element 22 having a high-pressure valve element 23 and a low-pressure valve element 24 integrally formed therewith is held in a manner movable along the axis of a body 21 by a guide 61 which is integrally formed with a plug 26 forming a valve seat 25 for the high-pressure valve element 23. The guide 61 has a communication hole 62 for communicating with a space accommodating a spring 29 such that a pressure Pc in a port 33 is equally applied to the valve element 22 in axially opposite directions, whereby influence of the pressure Pc on motion of the valve element 22 is canceled out. Further, the high-pressure valve element 23 has an end formed to have an acute angle, while the low-pressure valve element 24 has an end formed to have an obtuse angle. It should be noted that a solenoid arranged below the low-pressure valve element 24, as viewed in the figure, and a mechanism for urging the valve element 22 by the solenoid via a shaft 30 are constructed similarly to those of the capacity control valves 11, 11*a*, 11*b* according to the first to third embodiments shown in FIGS. 2 to 4.

In the capacity control valve 60 having the three-way valve structure described above, when no control current is supplied to a solenoid coil 47 of the solenoid, as shown in FIG. 6, the high-pressure valve element 23 between the discharge pressure Pd and the pressure Pc in the pressure-regulating chamber 1 is fully opened, whereas the low-pressure valve element 24 between the pressure Pc in the pressure-regulating chamber 1 and the suction pressure Ps is fully closed. A movable core 42 of the solenoid is held away from a fixed core 36 due to a balance between spring loads of springs 29, 45, 46. Therefore, the pressure Pc of the pressure-regulating chamber 1 becomes close to the discharge pressure Pd, which minimizes the difference between pressures applied to the both end faces of the piston 6. As a result, the wobble plate 4 is controlled to a degree of inclination which minimizes the stroke of the pistons 6, whereby the variable displacement compressor is promptly switched to the minimum capacity operation.

When a maximum control current is supplied to the solenoid coil 47 of the solenoid, the movable core 42 is attracted by the fixed core 36 to be moved upward, as viewed in the figure, whereby the three-way valve has the high-pressure valve element 23 thereof fully closing the passage associated therewith and the low-pressure valve element 24 thereof fully opening the passage associated therewith. Then, in addition to a very small amount of refrigerant having been permitted to flow out from the pressure-regulating chamber 1 into the suction chamber 9 via the orifice 13, refrigerant in the pressure-regulating chamber 1 is permitted to flow out into the suction chamber 9 via the three-way valve. Therefore, the pressure Pc of the pressure-regulating chamber 1 becomes closer to the suction pressure Ps, which maximizes the difference between pressures applied to the both end faces of the piston 6. As a result, the wobble plate 4 is controlled to a degree of inclination which maximizes the stroke of the pistons 6, whereby the variable displacement compressor is promptly switched to the maximum capacity operation.

During normal control in which a predetermined control current is supplied to the solenoid coil 47 of the solenoid, the movable core 42 is attracted by the fixed core 36 to be moved upward, as viewed in the figure, according to the magnitude of the control current. Therefore, when the high-pressure valve element 23 is in a closed state, only on condition that the differential pressure between the discharge pressure Pd and the suction pressure Ps becomes larger than a value set according to the magnitude of the control current, the high-pressure valve element 23 starts to be opened to start capacity control.

Figure 7:
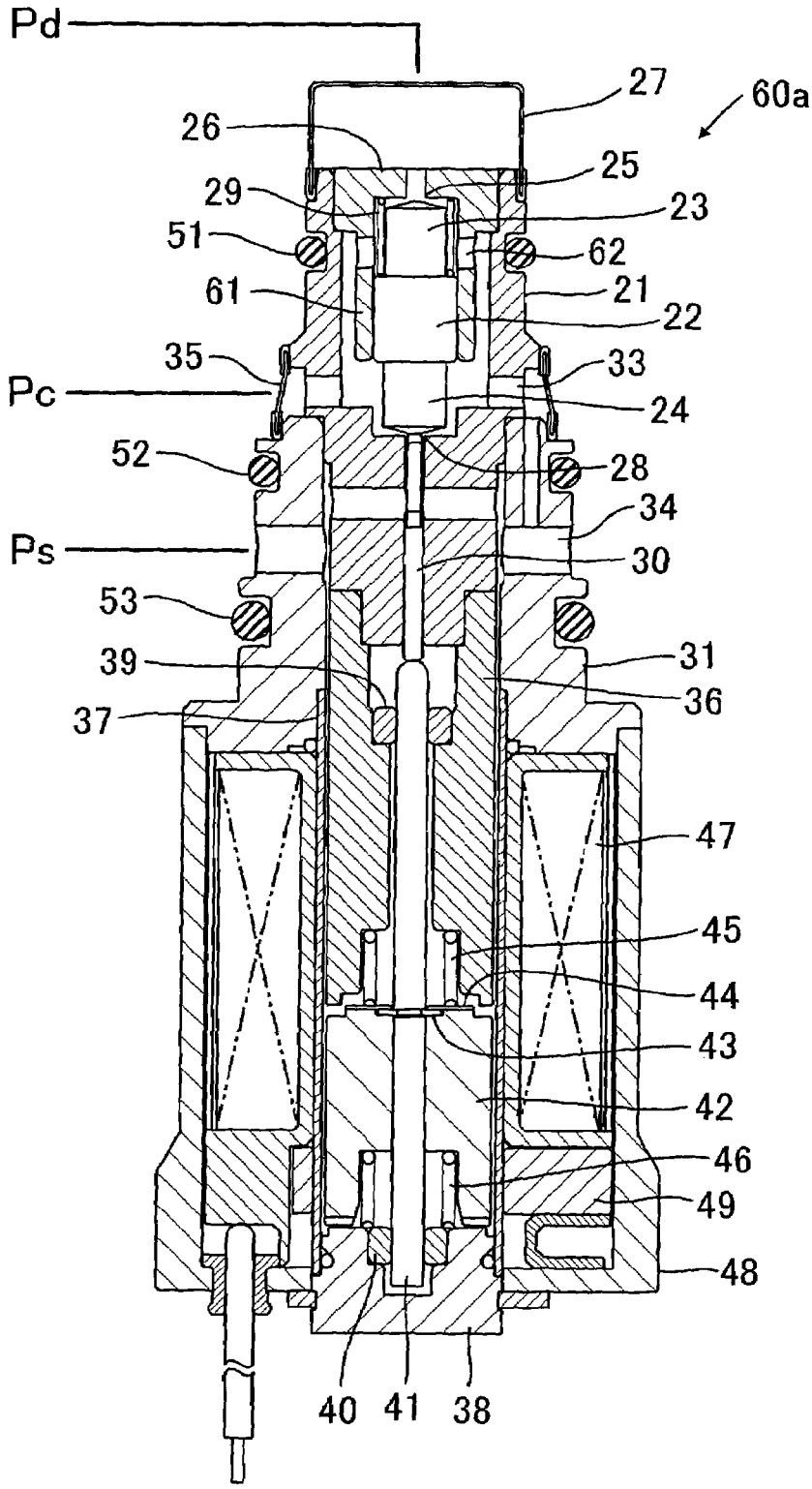
FIG. 7 is a central longitudinal sectional view showing a capacity control valve according to a fifth embodiment.
Figure 8:
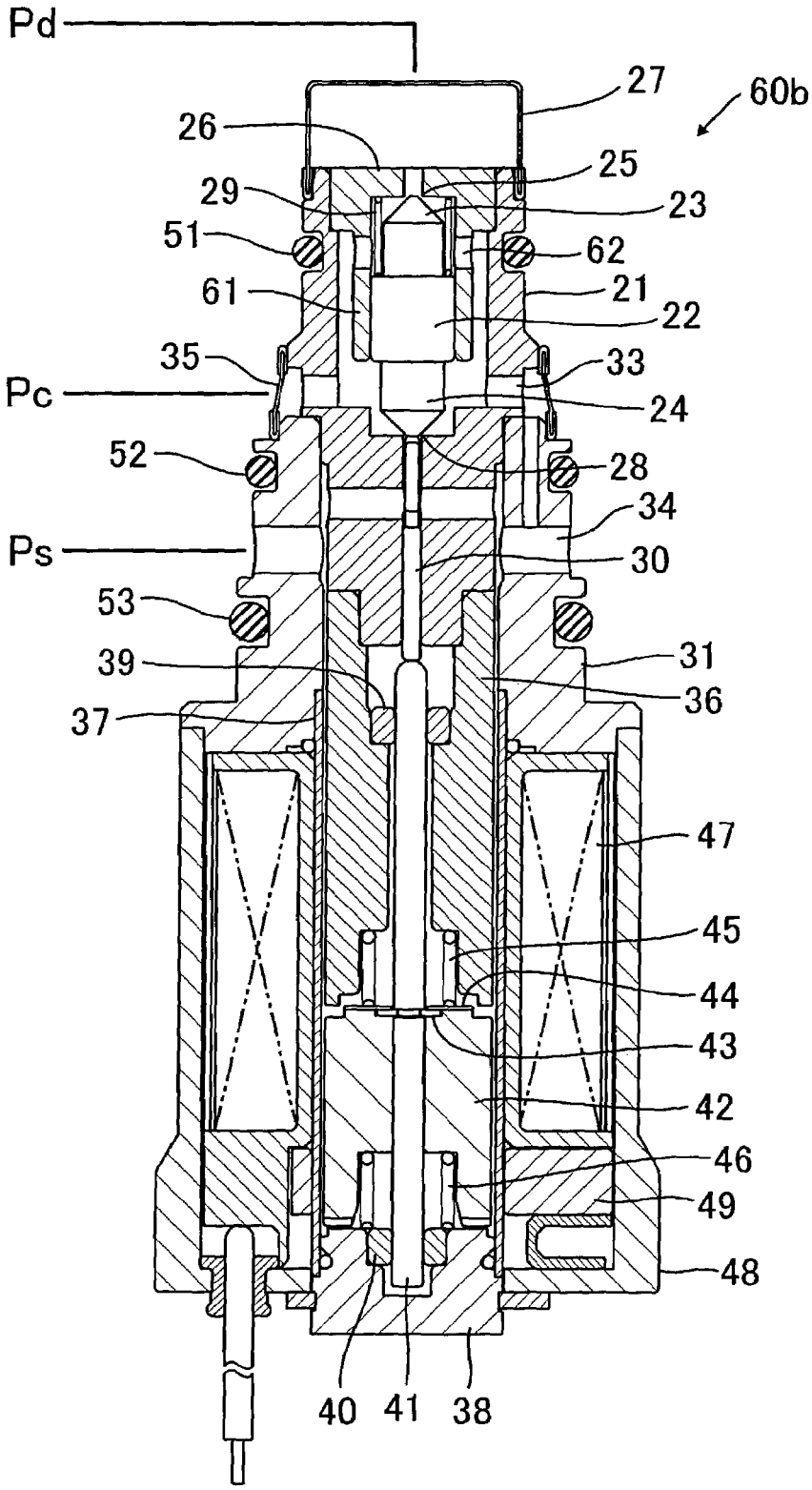
FIG. 8 is a central longitudinal sectional view showing a capacity control valve according to a sixth embodiment.

FIG. 7 is a central longitudinal sectional view showing a capacity control valve according to a fifth embodiment. FIG. 8 is a central longitudinal sectional view showing a capacity control valve according to a sixth embodiment. In FIGS. 7 and 8, component parts and elements similar to those shown in FIG. 6 are designated by identical reference numerals, and detailed description thereof is omitted.

The capacity control valves 60*a*, 60*b* according to the fifth and sixth embodiments basically have the same construction as the capacity control valve 60 according to the fourth embodiment. However, the FIG. 7 capacity control valve 60*a* according to the fifth embodiment is different from the capacity control valve 60 according to the fourth embodiment in that respective ends of a high-pressure valve element 23 and a low-pressure valve element 24 are both formed to have an obtuse angle. Further, the FIG. 8 capacity control valve 60*b* according to the sixth embodiment is different from the capacity control valve 60 according to the fourth embodiment in that respective ends of a high-pressure valve element 23 and a low-pressure valve element 24 are both formed to have an acute angle.

As described hereinbefore, according to the present invention, the capacity control valve is configured to have a three-way valve structure for opening and closing a refrigeration passage of the variable displacement compressor leading from a discharge chamber to a pressure-regulating chamber, and a refrigeration passage of the compressor leading from the pressure-regulating chamber to a suction chamber thereof, and at the same time, a discharge chamber-side and a suction chamber-side of the three-way valve have effective diameters of the same size. As a result, the pressure from the pressure-regulating chamber is equally applied onto the discharge chamber side of the three-way valve and the suction chamber side of the same, and hence is canceled out. This enables the three-way valve to perform capacity control only in response to the differential pressure between the suction pressure from the suction chamber and the discharge pressure from the discharge chamber, without being adversely affected by the pressure from the pressure-regulating chamber during the capacity control operation.

Further, no orifice for capacity control is provided in the refrigeration passage for control of the flow rate of refrigerant which extends from the discharge chamber to the suction chamber via the pressure-regulating chamber, but the three-way valve is arranged thereacross which has a valve hole sufficiently larger than that of the conventional orifice. Therefore, it is possible to absorb manufacturing tolerances of orifices of the variable displacement compressor arranged in parallel with the three-way valve and a variation in the amount of leakage of refrigerant from the pistons, and allow lowering of machining accuracy required of the variable displacement compressor. This enables reduction of manufacturing costs of the variable displacement compressor.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A capacity control valve for a variable displacement compressor, for controlling an amount of refrigerant introduced from a discharge chamber into a pressure-regulating chamber, such that the differential pressure between a pressure in a suction chamber and a pressure in the discharge chamber is held at a predetermined differential pressure, to thereby change an amount of the refrigerant discharged from the variable displacement compressor, comprising:

a first valve inserted into a first refrigerant passage between a first port communicating with the discharge chamber and a second port communicating with the pressure-regulating chamber, for opening and closing the first refrigerant passage; and a second valve inserted into a second refrigerant passage between the second port communicating with the pressure-regulating chamber and a third port communicating with the suction chamber, a valve seat of the second valve having the same effective diameter as that a valve seat of the first valve, for opening and closing the second refrigerant passage in conjunction with the first valve, and a solenoid for applying a load to the first valve in a valve-closing direction, and to the second valve in a valve-opening direction, the load being dependent on a value of supply current.

2. A capacity control valve for a variable displacement compressor, for controlling an amount of refrigerant introduced from a discharge chamber into a pressure-regulating chamber, such that the differential pressure between a pressure in a suction chamber and a pressure in the discharge chamber is held at a predetermined differential pressure, to thereby change an amount of the refrigerant discharged from the variable displacement compressor, comprising:

a first valve inserted into a first refrigerant passage between a first port communicating with the discharge chamber and a second port extending from a downstream side of the first valve to the pressure-regulating chamber, for opening and closing the first refrigerant passage; and a second valve inserted into a second refrigerant passage between a third port extending from the pressure-regulating chamber to an upstream side of the second valve, formed separately from the second port, and a fourth port communicating with the suction chamber, a valve seat of the second valve having the same effective diameter as a valve seat of the first valve, for opening and closing the second refrigerant passage in conjunction with the first valve.

3. The capacity control valve according to claim 1 or 2, wherein a first valve element of the first valve and a second valve element of the second valve are arranged on axially both sides along the same axis, and at the same time integrally formed with each other.

4. The capacity control valve according to claim 1 or 2, wherein respective ends of the first valve element of the first valve and the second valve element of the second valve are formed to have the same shape.

5. The capacity control valve according to claim 1 or 2, wherein an end of the first valve element of the first valve is formed to have an acuter angle than an end of the second valve element of the second valve.

* * * * *